United States Patent [19]

Brendgord et al.

[11] 4,037,096

[45] July 19, 1977

[54] ILLUMINATOR APPARATUS USING OPTICAL REFLECTIVE METHODS

[75] Inventors: Thomas Brendgord; Kenneth J. Fisher, both of Erie, Pa.

[73] Assignee: American Sterilizer Company, Erie, Pa.

[21] Appl. No.: 496,166

[22] Filed: Aug. 9, 1974

[51] Int. Cl.[2] ..... A61G 13/00; F21V 33/00

[52] U.S. Cl. ..... 240/1.4; 240/41.15; 240/47

[58] Field of Search ..... 240/1.4, 41.15, 47

[56] References Cited

U.S. PATENT DOCUMENTS

| | | | |
|---|---|---|---|
| 2,226,300 | 12/1940 | Alexander | 240/1.4 |
| 2,280,402 | 4/1942 | Creppin | 240/1.4 X |
| 2,433,982 | 1/1948 | Clarkson, Jr. et al. | 240/1.4 |
| 3,119,567 | 1/1964 | Schwartz | 240/47 |
| 3,255,342 | 6/1966 | Seitz et al. | 240/1.4 |
| 3,446,952 | 5/1969 | Sitter et al. | 240/1.4 |
| 3,609,335 | 9/1971 | Kelly | 240/1.4 |
| 3,626,170 | 12/1971 | Schwan | 240/1.4 |

FOREIGN PATENT DOCUMENTS

| | | | |
|---|---|---|---|
| 974,128 | 9/1950 | France | 240/1.4 |
| 375,943 | 7/1932 | United Kingdom | 240/1.4 |

*Primary Examiner*—L. T. Hix
*Assistant Examiner*—J. A. La Barre
*Attorney, Agent, or Firm*—Shanley, O'Neil and Baker

[57] ABSTRACT

Illuminator apparatus and reflective optical methods directed to meeting the stringent requirements of surgical lighting and similar requirement uses. In the optical system, axially symmetrical light source means and multiple reflectors project light rays in a converging light pattern of uniform light intensity. The angled approach of light to the illuminated area reduces shadow formation and forms a shadow-free zone for location of fixture handling and pattern controls. Heat projection is reduced or minimized optically and the physical arrangement of the support structure provides for removal of heat from the area. Color correction, if required, can be achieved optically without relying on increase in or control of source intensity.

10 Claims, 6 Drawing Figures

ILLUMINATOR APPARATUS USING OPTICAL REFLECTIVE METHODS

This invention involves illuminator apparatus and optical reflective methods. A more specific aspect of the invention is an illuminator for surgical lighting uses providing substantial shadow reduction and uniform lighting of an illuminated area. The invention is also concerned with reducing heat projection and removal of heat in surgical lighting.

Prior approaches to better surgical lighting have generally relied on increasing the size of lighting fixtures, or increasing the number of light sources used, and/or increasing the wattage or intensity of the source or sources used. More than 15 light sources and over 1500 watts are used in some lighting arrangements marketed for a single operating table. The resultant heat projection of such lighting arrangements can adversely affect both patients and operating personnel and often overloads electrical and air conditioning systems.

The heavy weight and large bulk involved in such systems can make it difficult for operating personnel to adjust location of the fixture or concentrate illumination readily where most needed. Also, a significant portion of the light emanating from the source(s) is blocked and never reaches the area to be illuminated. Further, the weight, bulk, and electrical demands increase the cost of manufacture and operation.

Such difficulties and shortcomings experienced with prior art surgical lighting systems are eliminated or substantially reduced by a multiple-reflector, plural-light-path luminaire which does not rely on plural spaced light sources or high wattage sources. This rugged, light-weight reflective system provides desired illumination more efficiently; i.e., regardless of the type of light source the output to input ratio is higher than conventional surgical illuminations because blockage of light is avoided. This is accomplished without relying on heavy and costly optical refracting lenses and, without significant stray radiation. In addition, light is projected so as to reduce shadow formation on the illuminated area nothwithstanding location of opaque objects or placement of obstructions intermediate the illuminator and the area to be illuminated. Further, proper color clarity, an important aspect in surgery, is achieved, with both selectivity and color correction being provided, without being required to rely on changes in the power supply or temperature of the light source. Also pattern location and pattern size are easily adjustable from the sterile side of the illuminator.

Figure 1:
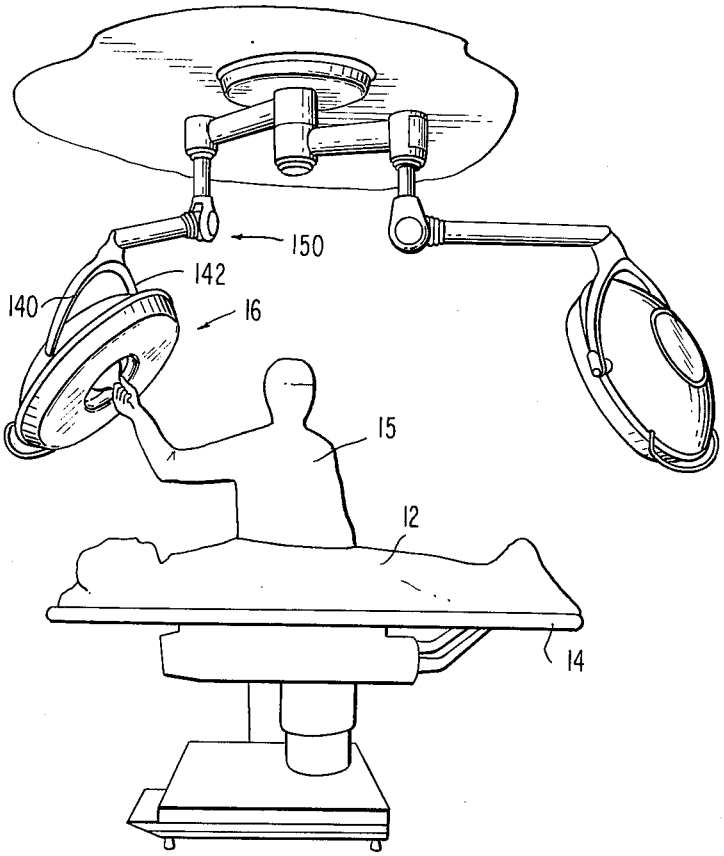
Figure 5:
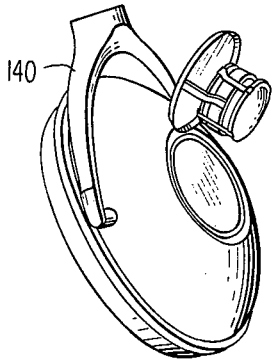
Figure 6:
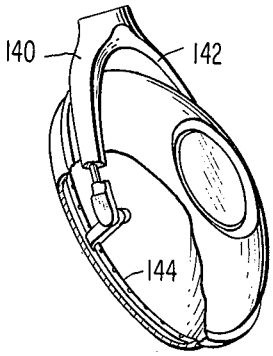
Figure 2:
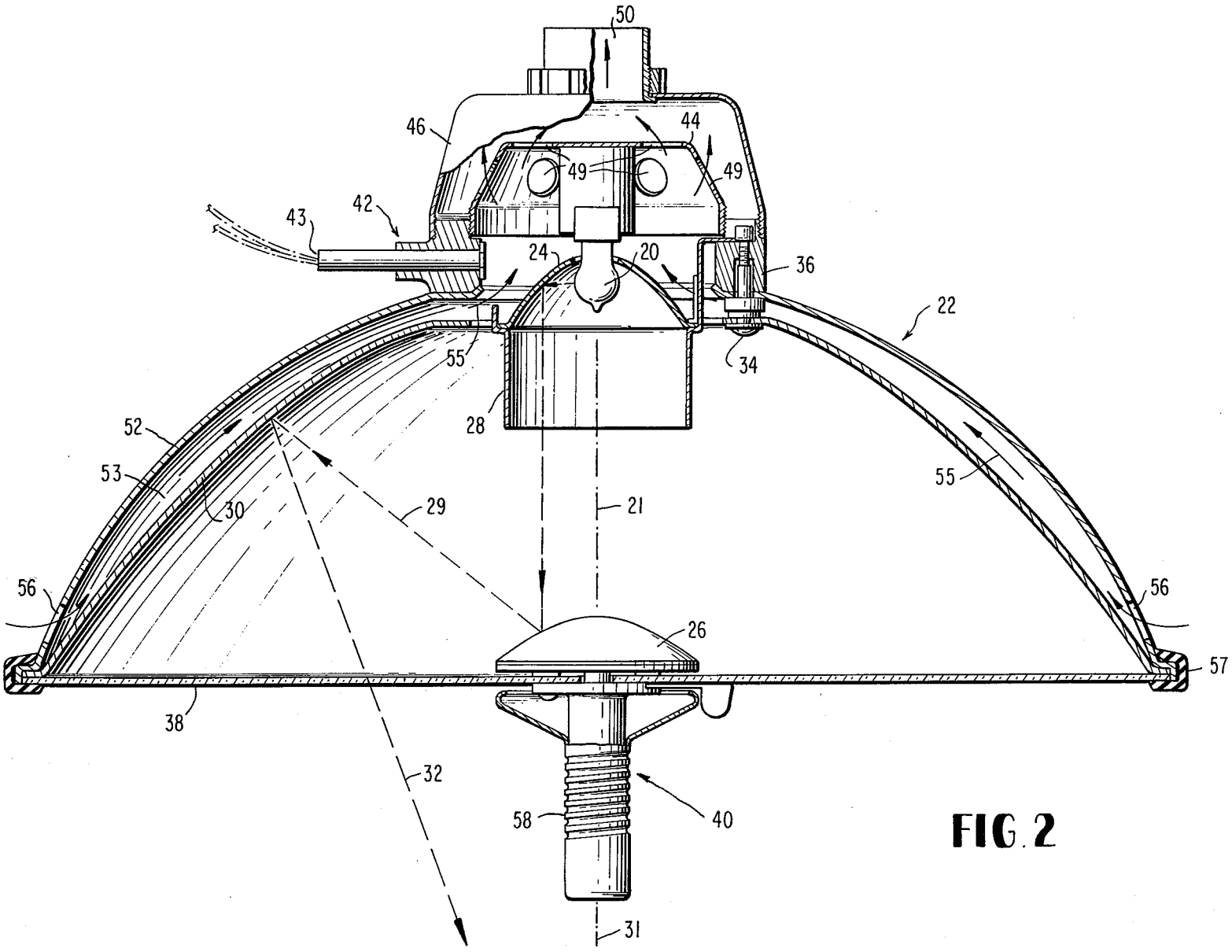
Figure 3:
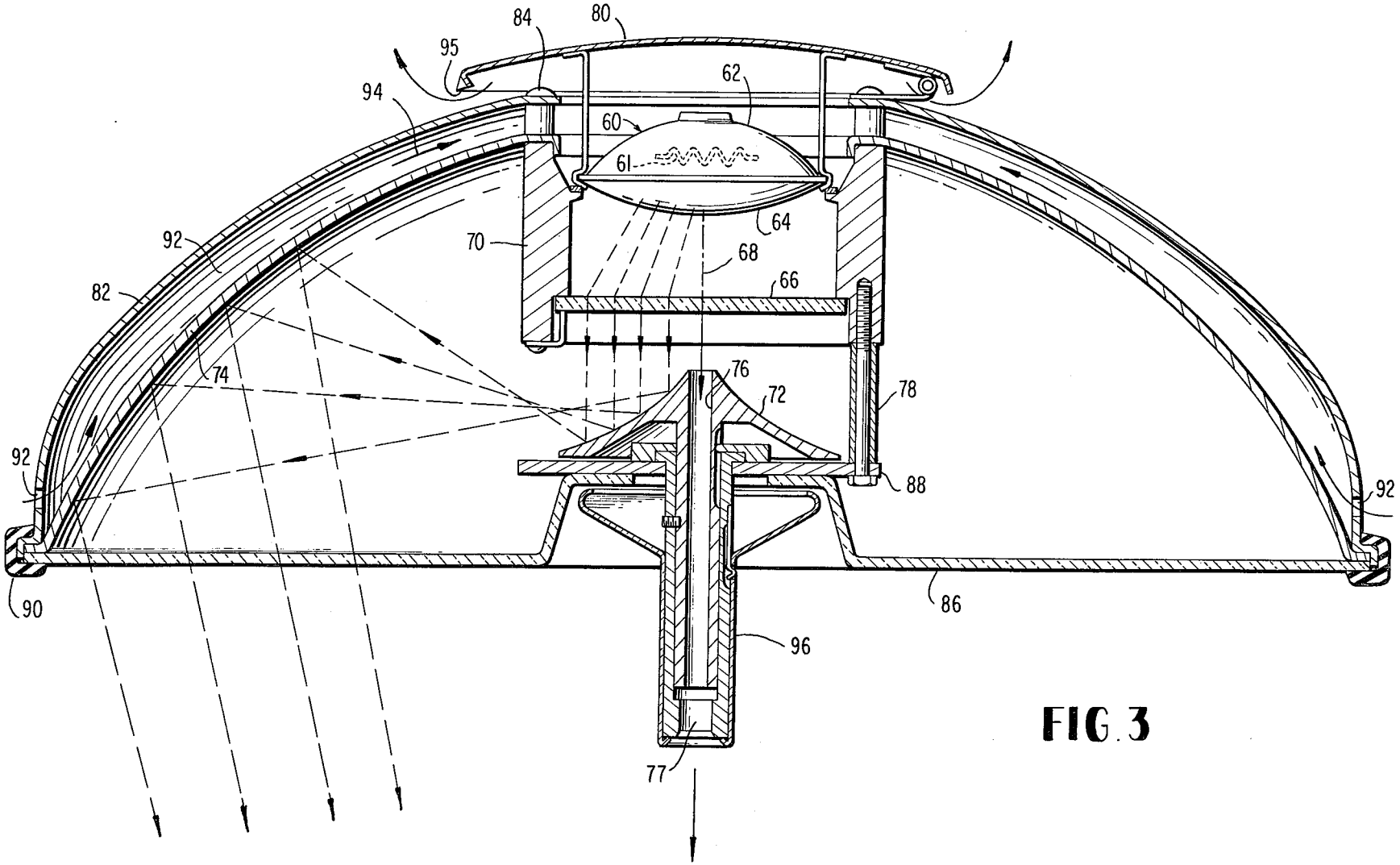
Figure 4:
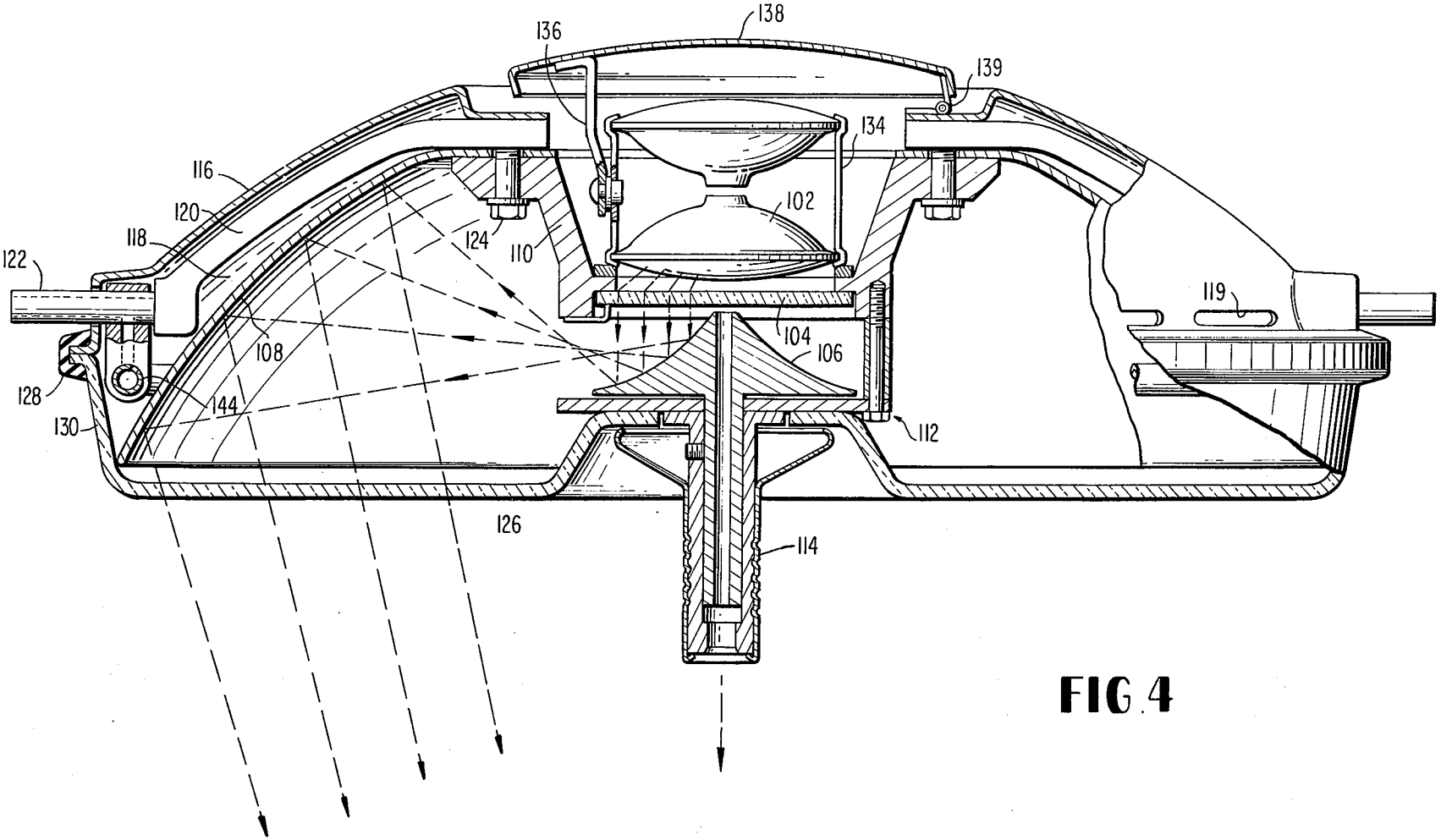

Other objects and contributions of the invention will be considered in describing the invention shown in the accompanying drawings. In these drawings:

FIG. 1 is a perspective view showing the invention in use in a surgical room environment, FIG. 2 is a cross-sectional, partially schematic, view in elevation of illuminator apparatus in accordance with the invention, FIG. 3 is a view in elevation of illuminator apparatus embodying the invention with portions cut away and portions shown in cross-section, FIG. 4 is a view in elevation of illuminator apparatus in accordance with the invention with portions cut away and portions shown in cross-section, FIG. 5 is a rear view in perspective of the illuminator apparatus of FIG. 4 shown in an open position for changing a light source from the "dark" side of the illuminator apparatus, and FIG. 6 is a rear view in perspective of the illuminator apparatus of FIG. 4 with portions cut away to show heat removal features.

In the surgical environment depicted in FIG. 1, a patient 12 is shown on operating table 14 with a member 15 of the surgical personnel adjusting the positioning and/or pattern of illuminator 16 from the sterile ("clean") side of the lamp. The rearward side, i.e. the non-illuminated side of illuminator 18, is often referred to as the non-sterile or "dirty" side. One of the contributions of the present invention is that the illuminator is easily adjustable from the "clean" side and need only be contacted by "clean" personnel.

Elements for carrying out the multi-reflection principle of the invention so as to efficiently project light rays while reducing shadow formation and heat projection are shown in FIG. 2. Light source 20 is located along the axis of symmetry 21 of illuminator 22. Opposite to light source 20 and its reflector 24, and located along the axis of symmetry 21 toward the area of illumination, an additional reflector 26 is positioned in transverse relationship to the axis of symmetry.

Source reflector 24 is contiguous to the light source 20 and in generally circumscribing relationship, i.e. partially surrounding or enveloping the light source. A double curved surface is provided for desired collimated projection of reflected light rays. Such source reflector 24 may be generally parabolic in a cross-sectional configuration; other shapes which can be adopted to the use are hemispherical, hyperbolic, and elliptical. Reflector 24 receives light rays directly from light source 20 and reflects such impinging light rays in a generally axial direction toward reflector 26. Preferably such rays are projected substantially parallel to the axis of symmetry 21 by a deep parabolic configuration which provides reflectance and satisfactory collimation efficiently. Source reflector 24 opens toward reflector 26. Cylinder 28, which may be located at the open end of source reflector 24 to aid in collimating the rays could be coated black on its interior surface to reduce stray radiation.

The light rays from source 20 are directed to have a major component which is axial and to impinge on reflector 26, referred to as the transversely-directing reflector. Such impinging light rays are reflected so that a major component of the reflected light (e.g. light ray 29) has a direction transverse to the axis of symmetry 21. The surface configuration of transversely-directing reflector 26 directs the light rays radially outwardly as indicated. Transversely-directing reflector 26 may have a double curved surface, e.g. the dome shaped configuration shown in FIG. 2.

Substantially all light rays impinging on transversely-directing reflector 26 are directed outwardly. However, as will be explained in more detail later, an aperture along the axis of symmetry can be provided for projecting a small bore, collimated, aiming light beam.

As shown in FIG. 2, source reflector 24 and transversely-directing reflector 26 are disposed in generally transverse relationship to the axis of symmetry. The light source 20, source reflector 24, and transversely-directing reflector 26 are each contiguous to the axis of symmetry and are disposed symmetrically with relation to such axis. A further reflecting surface is radially spaced from such elements. Such radially-spaced reflector 30 has a working surface which directs the impinging rays in a forward direction and angled toward the axis of symmetry, or its extension, i.e. the principal axis of illumination. Radially spaced reflector 30 may also have a double curved reflecting surface. It is positioned in surrounding or circumscribing relation to at least a portion of the light path between source reflector 24 and transversely-directing reflector 26.

The radially-spaced reflector 30 receives only light reflected from transversely-directing reflector 26. It reflects such impinging light rays toward the area to be illuminated in angled relation toward an extension 31 of the axis of symmetry 21, as illustrated by light ray path 32. Extension 31 of the axis of symmetry coincides with the principal axis of the projected light rays. The result is a converging light pattern when viewed in cross-section, i.e. in a plane including the axis of symmetry. This converging configuration for the light rays plays an important role in diminishing shadow formation because of the angled approach of the light rays to the illuminated area.

For structure support purposes, part of the radially-spaced reflector 30 can extend (upwardly) beyond its actual reflecting surface toward the illuminator axis of symmetry as shown in FIG. 2. Reflector 30 can be supported by means such as bolt 34 in spaced relationship from mounting ring 36.

At the lower periphery of radially-spaced reflector 30, i.e. toward the illuminating side of the lamp, a light transmitting dust shield 38 is supported around its entire periphery. Dust shield 38 is connected, at its central portion, to mounting means for transversely-directing reflector 26 and handle means 40; the structure and function of the mounting means and handle means 40, and providing additional internal support for these items will be described in more detail later.

Important aspects of the invention relate to provisions for removing heat to the dark side of the illuminator, and from the area, and, also, eliminating or minimizing heat projection. These aspects and related contributions of the invention are considered in further description of the structures shown.

As seen in FIG. 2 the support structure for the illuminator includes a main support base 42 defining a power supply access 43. The lamp assembly 44 is mounted within the main exterior housing 46. For purposes of reducing heat projection, source reflector 24 is provided with selective frequency properties. For the surgical light illustrated, source reflector 24 is characterized by "cold mirror" properties. That is, to the extent practicable while maintaining desired light reflection efficiency, substantially all infra-red is transmitted through source reflector 24 and substantially all visible light is reflected.

Part of the contribution of the invention is provision for efficiently and economically removing most of the heat directly. E.g. the generated heat at light source 20 is removed directly. Also the heat from the infra-red rays transmitted by source reflector 24 is removed directly. Heat from these sources passes through the wall of the light assembly 44 at vents 48, 49 and out the axially-located, main housing vent 50. The structure shown provides for complete heat removal; main housing vent 50 may be vented outside the room in which the illuminator is used and may be vented by force draft with mechanically driven means (not shown). The venting gas flow is indicated by arrows. Intake of venting gas from the lower periphery of the illuminator is provided.

Radially-spaced reflector 30 can be provided with selective frequency properties to further minimize or eliminate heat projection. In the surgical light illustrated radially-spaced reflector 30 can have the same "cold mirror" properties described above. The heat passing through radially-spaced reflector 30 is vented through a plenum to the main housing and outside vent. For example, exterior shell 52 defines a plenum 53 about the radially-spaced reflector 30. This plenum is vented as indicated by arrows 54 and 55 through the main housing 56 and out the exhaust 50. Air intake vents 56 are provided about the lower periphery of shell 52 to provide for natural convective flow or as forced draft inlets.

Transversely-directing reflector 26 has "first surface" or metal mirror reflection characteristics, i.e. it reflects all light impingement including any infra-red which may be received. Thus substantially no light rays and in particular no infra-red is projected directly to the area to be illuminated. The reflected light from transversely-directing reflector 26 impinges on radially-spaced reflector 30 where remaining infra-red radiation, if any, can be largely removed by selection of the cold mirror characteristics for this reflector. The result is that the heat, and the venting atmosphere or air carrying such heat, is vented to the non-illuminated side, i.e. the non-sterile side in surgery, either by convection or forced draft. The exterior shell 52 is sealed to reflector 30 and the light transmitting dust shield 38 by gasket means 57. Vents such as 56 are provided around the lower periphery of outer shell 52. With these arrangements, heat projection can be reduced or substantially eliminated. In accordance with the teachings of the invention, it is possible to remove substantially all projected infra-red and correct the color of the light projected by using proper characteristics for the source reflection and the radially spaced reflector. However, partial removal of infra-red by selection of characteristics for a single element or characteristics of a selected combination of these elements can be used for economy and/or light efficiency purposes, without departing from the basic teachings of the invention.

Another significant contribution of multi-reflector principle is related to the positioning of transversely-directing reflector 26. It should be noted that the reflection of all light rays by reflector 26 toward the circumscribing radially-spaced reflector 30 provides a zone where an adjustment handle can be located without blocking any of the rays to be projected to the illuminated area. Handle 58 is mounted in this zone and is threaded to the mounting of transversely-directing reflector 26 so that the reflector can be moved axially within the illuminator. Adjustment of reflector 26 along the axis of symmetry will change the cross-sectional area of the illuminated pattern.

Light rays reflected by radially-spaced reflector 30 approach the illuminated area in angled relationship to the axis of symmetry rather than parallel to such axis. This reduces shadow formation when an object is introduced in the light path. The light rays, approaching from all angles, travel around the object thus minimizing shadow formation.

Additional light correction and support structure features of the invention are shown in FIG. 3. Light source structure 60 can be a halogen-tungsten bulb with a separate reflector or the filament can be in an enclosed structure having a unitary reflector as shown. In either event, the light source itself, e.g. filament light source means 61, is located contiguous to the axis of symmetry and symmetrical with such axis. Part of the enclosed structure is a source reflector 62 which can have cold mirror characteristics. On the axially opposite side of such source, a light transmitting cover 64, which can have color correcting characteristics with selective frequency transmitting properties, is provided.

Light rays from source means 61 are reflected in the forward direction by source reflector 62 to have a major component which is axial of the illuminator. These rays pass through a light transmitting element 66; for example element 66 can take the form of a Fresnel lens which collimates the light rays to travel in a direction substantially parallel to the axis of symmetry 68. Light transmitting element 66 is mounted so that it can be changed for different uses. An important aspect of this structural feature is that light transmitting element 66 can provide selected color correction and selected light frequency transmitting characteristics. Another important contribution is the containment aspect provided by element 66. In the event of source breakage, glass is contained within support structure, such as core 70. For this containment aspect, element 66 can be clear non-fragmenting material, glass or plastic.

Stray radiation is substantially eliminated by support structure core 70. Collimated light rays passing from light transmitting element 66 travel in substantially parallel relationship to the axis of symmetry 68 toward transversely-directing reflector 72. The reflecting surface of reflector 72 has a generally conical cross-section that can be double-curved as shown; such double curvature surface comprises the surface of revolution of an arc rotated about the axis of symmetry with its concave surface confronting the light source means. With this configuration impinging light rays are projected in a transverse direction as shown toward a radially spaced reflector surface 74. Such transversely-directing reflector 72 directs light rays to pass, in angled relationship to each other, through a focal point located intermediate the transversely-directing reflector 72 and the radially-spaced reflector 74.

From the radially spaced reflector surface 74 the rays are projected in a forward direction in a pattern which is converging in axial cross-section. None of the light rays are lost notwithstanding that the transversely-directing reflector is located in the forward direction from the source means. Provision is made for an aiming beam by utilization of a small bore aperture 76 along the axis of symmetry with a mounting means 77 for a fiber optic attachment.

Core 70 comprises the main housing support. The subassembly for the transversely-directing reflector 72 and its mounting structure are secured to the core by a plurality of spacer stud means, only one of which is shown at 78. Core 70 supports the light source structure 60, its access door assembly 80, light transmitting surface 66, and mounting pins for the assembly which are located above the working reflecting surface of reflector 74. Also exterior shell 82 and the extension of the radially-spaced reflector surface 74 are joined to the core by connector means such as 84. Light transmitting dust shield 86 is joined to mounting structure 88 for the transversely-directing reflector 72 and, at its periphery, is joined to the external shell 82 and reflector 74 by gasket connector means 90. The external shell 84 includes, about its lower periphery, venting apertures such as 92, to help provide a natural convection path for heat removal as indicated by the flow arrows.

Radially spaced reflector 74 can have cold mirror characteristics so that only visible light is projected and any infra-red is transmitted. Resultant heat is carried in heat plenum 92 and travels toward the non-illuminated side of the structure as indicated by arrow 94 and can be vented at vent means such as 95. Heat generated by the light source and heat from infra-red transmitted by source reflector 62 are similarly vented. Mechanically driven means (not shown) can be connected to the illuminator to create a forced draft or heat can be removed by natural convection along the paths indicated. .

Transversely-directing reflector 74 is mounted for axial movement along the axis of symmetry. A sterile handle 96 is rotated to provide such axial movement. Adjustment of the location of transversely-directing reflector 72 adjusts the size of the illuminated area. Reflector 72 is moved axially through the illustrated cam operated mechanism which is fixed to mounting structure 88.

With the structure of FIG. 3, heat projection can be substantially eliminated by use of a source reflector 62 of cold mirror characteristics, by providing light transmitting cover 64 or element 66 with hot mirror characteristics (that is transmitting visible light but not transmitting infra-red), and by coating the reflecting surface of reflector 74 to provide cold mirror characteristics.

Light structure 60 is mounted to provide for venting of heat to prevent a build-up of heat between surfaces 64 and 66. Both surfaces can contribute to color clarity and frequency selection. Also, if light transmitting element 66 is used for selective color correction and selective light transmitting properties, then any heat generated by blocking infra-red can be projected back through light transmitting surface 64 and the source reflector 62, and the heat will be naturally vented through vent means 95.

The reflecting surface of transversely-directing reflector 72 has "first surface" properties, that is reflecting all light impingement. To remove or reduce infra-red rays reflected by transversely-directing reflector 72 radially spaced reflector 74 can be provided with cold mirror characteristics over the area of its reflecting surface. Depending on the ultimate use of the illuminator, and demands of economic production, color correction can be provided, heat can be removed, and heat projection can be substantially eliminated or reduced to an acceptable level by selection of characteristics for one or more of the light reflecting or transmitting elements described.

Additional mounting structure features, elimination of stray radiation features, and selection of light sources provided by the invention are shown in the structure of FIG. 4. The multi-reflector optical paths are essentially as previously described in relation to FIG. 3. Bulb structure 102, which is in operating position, projects light through a light transmitting surface 104 onto the double curved, conical-like configuration, transversely-directing reflector 106. Impinging light rays are transversely directed to radially spaced reflector 108. Because of the double curved configuration of the transversely-directing reflectors of FIGS. 3 and 4, light beams are projected to crisscross in angled relationship at a focal point as shown intermediate the transversely-directing reflector and the radially spaced reflector. From radially spaced reflector 108, light rays are projected in a forward direction in the converging light pattern indicated.

The mounting structure places the working bulb 102 in closely spaced relationship, axially, to transversely-directing reflector 106 and this substantially eliminates stray radiation losses. Main housing core 110 supports the sub-assembly 112 for the transversely-directing reflector 106, its mounting structure, and adjustment handle 114 by selectively located spacer studs, one of which is shown. Exterior shell 116 in combination with radially spaced reflector 108 defines heat plenum 118. Support yoke 120 extends through heat plenum 118 and pivot mounting arm 122 extends through the shell 116. Radially spaced reflector 108, external shell 116, and yoke arm 120 are secured to main housing core 110 by stud means such as 124. Light transmitting dust shield 126 extends radially from the transversely-directing reflector structure 106 to the periphery of radially spaced reflector 108 and rearwardly to be joined with the external shell 116 at gasket connector means 128. The peripheral portion 130 of the dust shield 126 helps define the heat plenum chamber 118; also, such portion 130 can be opaque or partially opaque to eliminate or reduce light scattering and its planar surface can be frosted. Vents 119 can be used for natural convection venting or sealed for the forced draft described later.

Fail-safe operation and additional selection are provided by a light source means mounting wheel. Referring to FIGS. 4 and 5 an enclosed light source structure 102 is mounted in rotatable cartwheel structure 134. This cartwheel structure, through support arm means 136, is supported on access door 138 which is swing-mounted on hinge 139. The cartwheel structure 134 mounts a plurality of light sources which can be selectively rotated into operating position. This contribution provides ready replacement in case of failure of a bulb during use and also provides for selection of the type of light source. In the latter regard, the color temperature of the cartwheel mounted bulb structures can vary thus permitting a selection of color temperature depending upon end use, type of operation, or the like. The same source selection teachings are applicable to sources with separate reflectors so that a source and/or its reflector can be readily changed.

As will be understood from previous description: the source reflector for the bulb structures can have selective characteristics so as to reflect visible light and transmit infra-red; the light transmitting element 104 in addition to, or in place of, collimating light rays, can provide color correction, can polarize light, and can reflect infra-red. Also the containment feature described earlier is provided. The reflecting surface of transversely-directing reflector 106 has "first surface" characteristics so that all impinging light rays are reflected transversely; the reflecting surface of radially spaced reflector 108 can have cold mirror characteristics so as to reflect visible light and transmit infra-red. Heat projection can be substantially eliminated, or reduced, by selection of the surfaces discussed to meet the specifications of the particular application.

Ease of movement of the luminaire with the centrally located handle means is an important aspect of the invention. The pivot arm structures for the lamp, such as 122, provide an axis of rotation lying in a plane which is contiguous to the center of gravity of the illuminator so that rotation about its axis and movement of the illuminator by the handle 114 is facilitated.

As shown in FIGS. 5 and 6 the arc shaped support arms 140 and 142 are connected to pivot points such as 122. An additional contribution results from this structure; arms 140, 142 readily provide the electrical supply and forced draft venting where needed and without obstruction. An apertured vent tube 144 within the heat plenum of the lamp is used for force draft removal of heat; it is connected through a hollow passage of one of the support arms, such as 140 as shown in FIG. 6. The hollow conduits of the support arms, such as 140 and 142, are connected through conduit passages in the overhead support structure 150 for access of power lines and removal of heat.

FIG. 5 illustrates one arrangement for changing of the light source; with the access door open, the cartwheel mounting for the plural source structures can be rotated.

Using the teachings of the present invention, an illuminator having an overall diameter of 22 inches and a light source of 150 watts can meet, or exceed, present specifications for surgical lighting, i.e. providing a minimum of 2500 foot candles directed to the center of a 10 inch diameter circular pattern measured at 42 inches from the cover glass or lower edge of the outer reflector. These specifications are set forth in more detail in "Lighting For Hospitals" (page 12) prepared by the Subcommittee on Hospital Lighting of the Institutions Committee of Illuminating Engineering Society, 345 E. 47th Street, New York, N.Y. 10017, published in the June 1966 issue of Illuminating Engineering.

The shallow depth of the illuminating apparatus made possible with the use of structures as those shown in FIGS. 3 and 4 is another contribution of the invention. The overall depth of a luminaire can be approximately 6 inches. This contrasts considerably with the illuminators available for surgical lighting in the prior art and practice. The shallow depth is available because the light paths cross as shown in drawings, in angled relationship, at a focal point intermediate to transversely directing reflector and the radially spaced reflector.

Several advantages of the shallow depth configuration are a reduction in the reflective surface area needed to be coated on the outer reflector, a reduction in the overall bulkiness generally associated with surgical illuminating apparatus thus providing better handling capabilities, e.g. the illuminator can be positioned higher under the suspension system and can be moved easier. Also by decreasing the depth of the luminaire, the shielding required to eliminate stray radiation or light scattering is reduced and, this helps to contribute to efficient light utilization.

Cold mirror and hot mirror surfaces for selectively reflecting or transmitting visible light are generally well known, being made of a glass or an organic plastic substrate coated with a dichroic filter. Typically such a filter could comprise a semi-conductor film, such as germanium, silicon, antimony sulphide or selenium, coated with thin dielectric material film or films of such thickness or index of refraction to minimize reflection of selected wavelengths and maximize other wavelengths. Known dielectric films include zinc sulphide, magnesium fluoride, aluminum oxide or magnesium oxide.

Utilizing the teachings of the invention and the known technology in heat reflecting/visible light transmitting and visible light transmitting/heat reflecting filters, characteristics for the various reflecting or transmitting surfaces described can be selected to provide desired economy in manufacturing and desired efficiency and light utilization. Within the multiple reflection principles and heat removal teachings of the invention, light utilization is maximized by use of the source reflector for transmitting heat, reflecting visible light, and providing adequate collimation.

One of the direct advantages in meeting established specifications for surgical lighting with a low power light source is that it facilitates use of a low voltage electrical source; e.g. a 24 volt source rather than the more conventional one hundred ten volt. The effect of being able to use a low voltage source further contributes to the efficacy of the illuminator apparatus. With a low voltage source, the light filament can be shorter in length, thus approaching the ideal "point" light source located on the axis of symmetry. The reduced surface of a smaller filament increases the temperature of the filament which increases the efficiency of the light source. The shorter length heavier gage filament used is stronger — less subject to shock and vibration, resists sagging, does not require supports, and has a longer life. Another advantage of the low power requirement is that heat projection problems are reduced initially.

Considering both economy and efficiency, reflective surfaces generally result in lower light losses than transmitting surfaces. However, where it is desired to use a light transmitting surface, the source power can be increased to compensate for any increase in losses because of the other inherent light efficiency advantages of the invention. Increases in source power, e.g. to 250 watts, can be utilized while still minimizing heat projection to maintain comfort and efficiency of personnel working under the illuminator. In addition to the cold mirror characteristics of the source reflector for reducing heat projection, the reflecting surface of the radially spaced reflector can be coated to have cold mirror characteristics. Further, use of a light transmitting element between the light source and the transversely-directing reflector provides a surface for hot mirror coating to block heat.

The color temperature (°K) for commonly used light sources is readily available. Similarly the spectral composition of common light sources can be readily determined. Such data shows, for example, that a standard incandescent light filament is rich in red and relatively deficient in blue. Other spectral distributions may be preferred for better detail discrimination against certain backgrounds. Correction in spectral distribution for a particular light source can be achieved with elements of the illuminator apparatus in place of seeking a new light source. This is an advantage because improving the color rendering properties of a light source often results in loss of efficiency (lumens per watt); further, special light sources of proper spectral distribution may not be readily available, or otherwise suitable, for a particular application.

A significant contribution of the multiple reflector teachings of the invention is the coaction between the reduction in heat projection and color correction. It is found that the reduction in heat projection provides a large measure of desired color balancing, i.e. in removing heat, the near infra-red is at least partially removed while maintaining the highly illuminating portions of the spectrum. Any further color correction required can be achieved without significant loss in lighting efficiency using known color reflecting coatings; for example, on the source reflector or radially spaced reflector or, through light transmitting surfaces such as surface 66 in FIG. 3. With the high efficiency light utilization teachings of the invention, surgical lighting requirements can be met without compensation for any minor light losses which may occur in making such spectral color distribution correction. Increases in power usage up to, for example, 200 or 250 watts where necessary for special applications, will nevertheless result in power usage significantly below that used in most commercial surgical light fixtures.

Exterior structure helps provide an illuminator which is easy to clean externally and which maintains internal cleanliness. Heat removal is accomplished along paths which avoid marking of internal light projecting surfaces with dust accumulations. The dust shield contributes to this feature and its frosted surface reduces direct glare and uncontrolled light scattering.

In disclosing the principles of the invention, various configurations of elements and materials have been specifically described. In the light of this disclosure various combinations of elements, and selections of materials or configurations are available without departing from the teachings of the invention. Therefore, in defining the scope of the invention reference should be had to the accompanying claims.

What is claimed is:

1. Illuminator apparatus for surgical lighting and similar lighting requirement uses comprising a luminaire having a reflective optical system which is free of refracting means and which projects light in a pattern which is converging in axial cross section and substantially symmetrical about the principal axis of projected rays, such principal axis of projected rays being coextensive with the axis of symmetry of the luminaire, the luminaire comprising light source means contiguous to the axis of symmetry and substantially symmetrically disposed with respect to the axis of symmetry, optical means establishing a plurality of light reflection paths and projecting light rays in a forward direction toward an area to be illuminated which is substantially transverse to such principal axis, internal frame means for positioning and supporting the light source means and optical means, and external shell means for the luminaire, the optical means comprising source reflector means operationally associated with the light source means, such source reflector means being at least partially circumscribing of the light source means to receive light rays directly from the light source means, the source reflector means reflecting light rays to have a major directional component which is substantially axial of the luminaire, a light reflecting surface forming part of a transversely-directing light reflector means and located to receive light rays reflected by the source reflector means and reflect substantially all frequencies of such impinging light rays to have a major directional component which is substantially transverse to the axis of symmetry, the light reflecting surface of the transversely-directing reflector means comprising a double curved reflecting surface of curved conical-like cross sectional configuration with the apex of such curved conical-like configuration oriented toward the light source means, such double curved reflecting surface of the transversely-directing reflector means comprising the surface of revolution of an arc about the axis of symmetry presenting its concave side in confronting relationship to the light source means, such transversely-directing reflector means and the source reflector means being located along the axis of symmetry in proximate relationship within the external shell means of the luminaire with the source reflector means and the transversely-directing reflector means being on axially opposite sides of the light source means, the source reflector means having a double curved reflecting surface located in surrounding relationship to the light source means and opening toward the transversely-directing reflector means with the transversely-directing reflector means receiving reflected light rays from the light source means, such source reflector means and transversely-directing reflector means each being disposed in substantially transverse relationship to and substantially symmetrical relationship with the axis of symmetry establishing a light path between the source reflector means and the transversely-directing reflector means which is contiguous to and circumscribes the axis of symmetry, and radially-spaced reflector means within the external shell means of the luminaire having light reflection surface means of double-curved curvilinear configuration radially spaced from and in circumscribing relationship to the transversely-directing reflector means and in circumscribing relationship to a major portion of the light path between the source reflector means and the transversely-directing reflector means, such radially-spaced reflector means being disposed substantially symmetrically with relation to the axis of symmetry in a position to receive solely light rays reflected from the transversely-directing reflector means, such light rays being reflected in angled relation to each other toward the radially-spaced reflector means so as to cross in focal relationship intermediate such transversely-directing reflector means and such circumscribing radially-spaced reflector means, the radially spaced reflector means reflecting such light rays with a major component in a forward direction toward the area to be illuminated in angled relation toward the principal axis, forming a converging pattern of light rays in axial cross-section, such angled reflection of light rays from the circumscribing radially-spaced reflector means reducing shadow formation within the converging pattern of light rays and establishing with such transversely-directing reflector means a zone having a conical configuration in axial cross-section and located along the principal axis contiguous to the illuminator and extending in the forward direction with its apex toward the area to be illuminated, such conical configuration zone being free of reflected light rays projected from the radially-spaced reflector, and being characterized by shadow-free properties with respect to reflected light rays projected by the radially-spaced reflector means.

2. The illuminator apparatus of claim 1 in which the source reflector means is located to reflect light rays from the light source means in the forward direction of the illuminator for impingement on the transversely-directing reflector means, and in which the source reflector means comprises a light reflecting surface which is reflective of substantially all visible light rays emanating from the light source means and is predominately non-reflective of infra-red light rays.

3. The illuminator apparatus of claim 2 in which a light-frequency-selective, light-transmitting surface is located axially between the light source means and the transversely-directing reflector means, such light transmitting surface means being frequency selective so as to project substantially all visible light rays while blocking at least a major portion of infra-red radiation from the light source means.

4. The illuminator apparatus of claim 2 in which the internal frame means further includes core support structure for the light source means and source reflector means, sub-assembly means for the transversely-directing reflector means, and means interconnecting such sub-assembly means to the core support structure.

5. The illuminator apparatus of claim 1 in which the source reflector means is located to reflect rays received from the light source means in the forward direction of the luminaire and further including heat venting means operatively associated with the light source means providing for removal of heat from the luminaire in a direction opposite to such forward direction.

6. The illuminator apparatus of claim 1 in which the external shell means of the luminaire defines a plenum chamber means circumscribing the radially-spaced reflector means.

7. The illuminator apparatus of claim 6 in which the external shell means is secured to the internal frame means and further including yoke means, for supporting the illuminator apparatus, connected to mounting stud means extending through the plenum chamber means, the mounting stud means defining an axis of rotation for the luminaire located in a plane normal to the axis of symmetry, which plane is contiguous to the center of gravity of the luminaire.

8. The illuminator apparatus of claim 6 further including venting means for removal of heat from the plenum chamber means.

9. The illuminator apparatus of claim 8 further including a pair of yoke arms located in the heat removal plenum chamber means for supporting the luminaire such yoke arms being connected to support studs extending through the external shell means in a plane which is contiguous to the plane of the center of gravity of the luminaire.

10. The illuminator apparatus of claim 1 in which the external shell means includes access means for the light source means located on the non-illuminated side of the luminaire permitting removal of the light source means from such non-sterile side of the luminaire.

* * * * *